US005484000A

United States Patent [19]

Hasselmann

[11] Patent Number: 5,484,000

[45] Date of Patent: Jan. 16, 1996

[54] VAPOR RECOVERY AND PROCESSING SYSTEM AND METHOD

[76] Inventor: Detlev E. M. Hasselmann, 519 S. Nardo, Solana Beach, Calif. 92075

[21] Appl. No.: 222,549

[22] Filed: Apr. 1, 1994

[51] Int. Cl.[6] ..... B67D 5/378

[52] U.S. Cl. ..... 141/7; 141/5; 141/45; 141/59; 141/52

[58] Field of Search ..... 141/5, 7, 44, 45, 141/47, 59, 290, 52, 83, 95; 431/5, 78, 202; 137/587–589

[56] References Cited

U.S. PATENT DOCUMENTS

| | | | |
|---|---|---|---|
| 3,913,633 | 10/1975 | Hiller | 141/45 |
| 3,999,936 | 12/1976 | Hasselmann | 431/202 |
| 4,009,985 | 3/1977 | Hirt | 431/5 |
| 4,010,779 | 3/1977 | Pollock et al. | 141/44 |
| 4,058,147 | 11/1977 | Stary et al. | 141/45 |
| 4,082,122 | 4/1978 | McGahey | 141/5 |
| 4,098,303 | 7/1978 | Gammell | 141/52 |
| 4,260,000 | 4/1981 | McGahey et al. | 141/59 |
| 4,295,504 | 10/1981 | Hasselmann | 141/290 |
| 4,295,505 | 10/1981 | Hasselmann et al. | 141/301 |
| 5,040,577 | 8/1991 | Pope | 141/59 |
| 5,244,018 | 9/1993 | Hasselmann | 141/59 |
| 5,291,922 | 3/1994 | Martin et al. | 141/59 |

OTHER PUBLICATIONS

Hirt, Vapor Control System, Trade Literature, 5 pages (1992).

Liston, A Study of Variables . . . Refueling of Automobiles, SRI, 3 pages (1975).

California Air Resource Board, Vapor Recovery: Fugitive Emissions, 10 pages (Feb. 1993).

*Primary Examiner*—J. Casimer Jacyna

*Attorney, Agent, or Firm*—Baker, Maxham, Jester & Meador

[57] ABSTRACT

A vacuum assisted vapor recovery system and method using a processing unit to process excess vapors collected during vehicle refueling with a bellowless nozzle. The system and method can be divided into two sequences of operation. The first sequence is the collection of vapors from the automobile during refueling. The second sequence is the return of vapors to a product storage tank with the processing of any excess vapors that would otherwise increase the pressure inside the storage tank. A single collection unit is used to collect the vapors as well as to send them to the storage tank and the processing unit. An improvement provides a recirculation loop in the collection unit to also control vapor growth in the underground storage tank. Pressure sensitive switches maintain a pressure level in the storage tank by activating the system if the pressure in the storage tank exceeds a predetermined threshold value. The processing unit processes any excess vapor and thus maintains the storage tank at a predetermined pressure level. The processing unit may be a combustion unit that incinerates the vapor.

19 Claims, 2 Drawing Sheets

FIG. 1
(PRIOR ART)
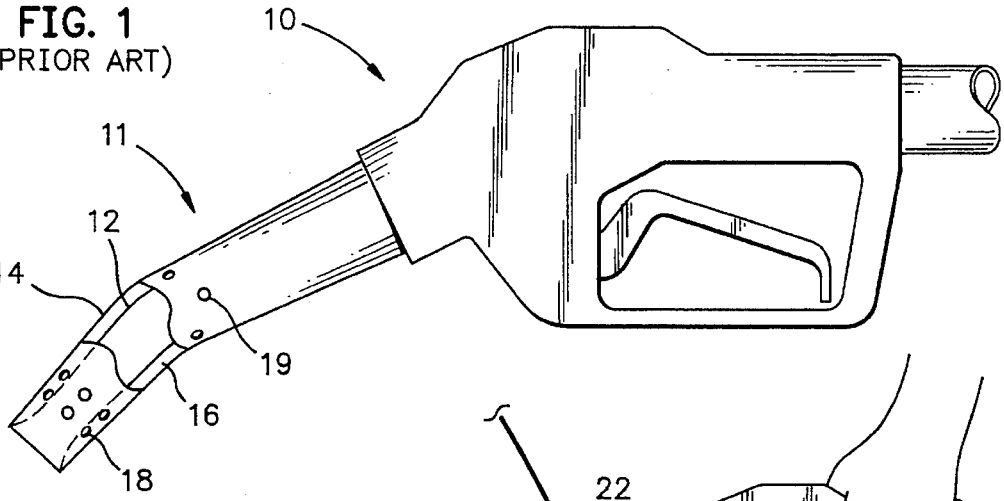
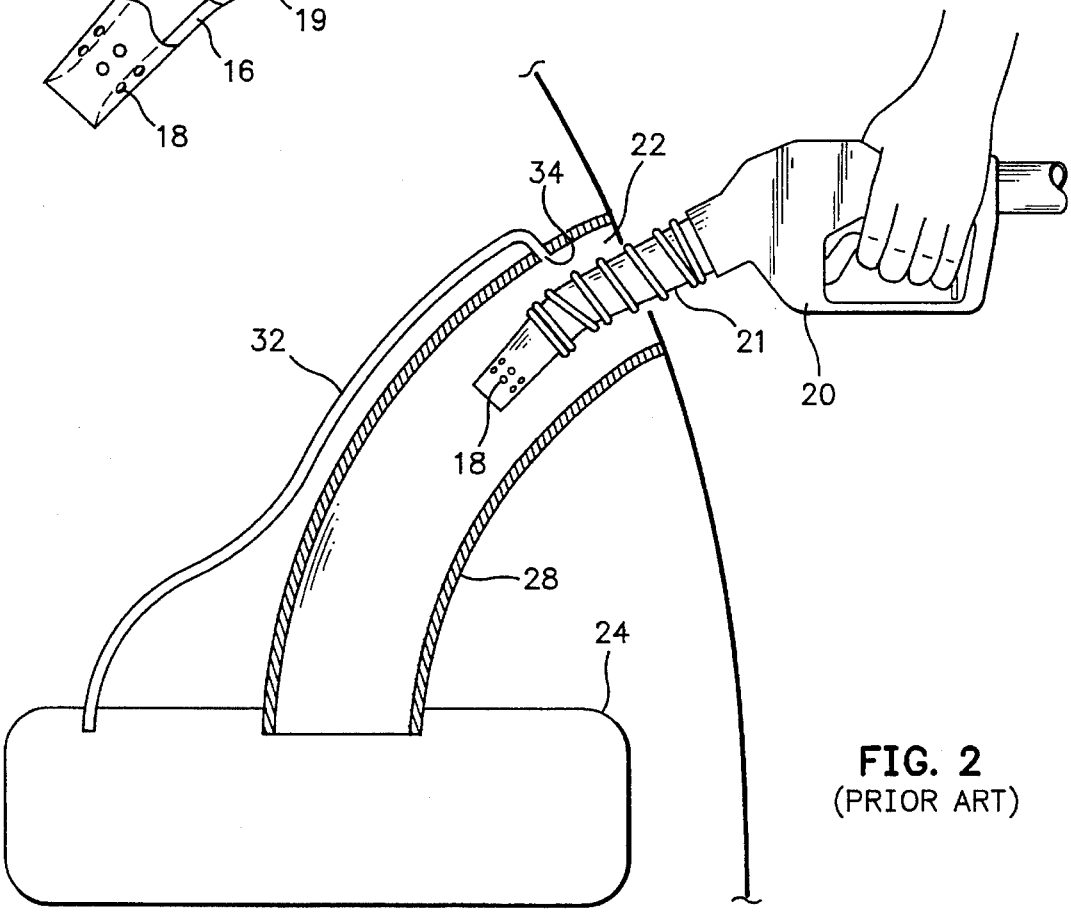
FIG. 2
(PRIOR ART)
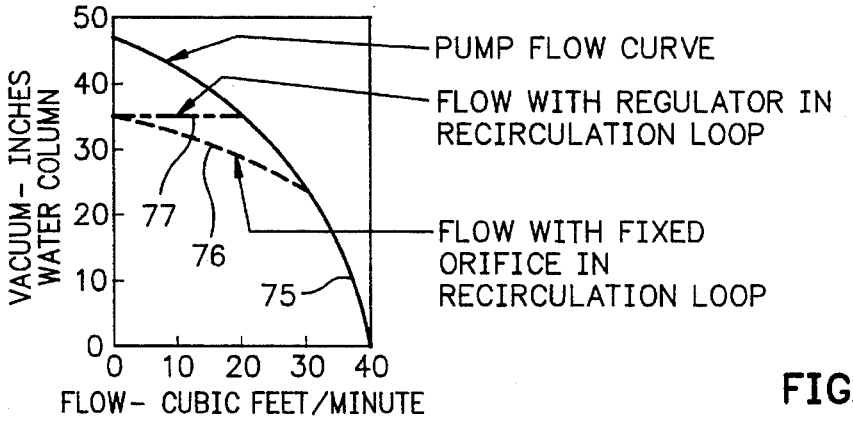
FIG. 5

VAPOR RECOVERY AND PROCESSING SYSTEM AND METHOD

FIELD OF THE INVENTION

This invention relates generally to vapor recovery systems used to control hydrocarbon emissions during vehicle refueling, and more particularly to a vacuum assisted vapor recovery system having a processor to process the excess vapors collected during fuel delivery, and the method of vapor recovery and processing.

DISCUSSION OF THE RELATED ART

Gasoline or other liquid dispensing nozzles are commonly provided with vapor recovery systems to lessen the amount of volatile and toxic, or otherwise undesirable vapors that might escape into the atmosphere when the liquid is dispensed. With specific reference to gasoline dispensing nozzles, such vapor recovery systems commonly use a nozzle with a rubber bellows concentrically enclosing the spout and do not employ a vacuum. Some nozzles require the bellows to form a tight seal, with no vacuum system required.

Gasoline dispensing nozzles with bellows have certain practical limitations. The bellows are heavy, bulky, awkward and expensive. The bellows also make it harder for users to insert and hold the spout in their vehicles'gasoline inlets. Bellowless nozzles have thus been proposed, as for example, in U.S. Pat. No. 5,244,018 to Hasselmann. A typical nozzle of the type disclosed by Hasselmann is depicted in FIG. 1 hereto. Dispensing nozzle 10 has spout 11 which is comprised of coaxial tubes 12 and 14. The coaxial tubes are arranged so as to form a fluid flow passageway inside the inner tube and a vapor return passageway in space 16 between the two tubes. That space is connected to a conventional vacuum system (not shown), which creates a vacuum in space 16 tending to draw vapor in through two sets of holes 18 and 19. Holes 18 are located adjacent the distal end of spout, and holes 19 are located further toward the handle, spaced from the distal end of the spout. Holes 19 are placed so that even when the nozzle is fully inserted into an unleaded gasoline inlet, they will lie outside a typical unleaded fuel restriction plate but within the vehicle outer fuel inlet.

Unleaded restriction plates in vehicle fuel tank fill necks are being phased out so an alternative nozzle is shown in FIG. 2. Here, nozzle 20 has spout 21 formed with only one set of holes 18 adjacent to the distal end of the spout. The spout is shown inserted into vehicle gasoline inlet 22 for filling tank 24 through tube 28. Vent tube 32 leads from the top of the tank to opening 34 in the inlet. Thus volatile vapors are removed from the tank during refueling by both tube 28 and tube 32. A vacuum pump is required to draw the vapors out through space 16 between the liquid supply tube and the external wall of the nozzle because the nozzle does not seal to the fill neck. This vacuum creates a low pressure zone which results in some outside air being drawn through the nozzle to the vapor recovery system.

Empirical results indicate that, when employing a bellowless nozzle, in order to collect 95% of the vapors displaced from an automobile tank, an amount of air equal to 20 to 40% of the displaced vapors will also be drawn in at the nozzle and carried to an underground fuel storage tank. This additional air evaporates gasoline in the storage tank, creating excess vapors which have in the past pressurized the storage tank. The pressurized storage tank can cause fugitive emissions from leaks in the system. Also differences between the temperature of fuel in the vehicle tank and that in the fuel storage tank can lead to excess vapors. Further, excess vapors may be created when more volatile fuels are added to less volatile fuels already in the vehicle tank (e.g., fuels intended for use in cold weather), and because fuel is splashed into the vehicle tank, resulting in agitated molecules of the fuel. Because the volume of the vapors has expanded due to the introduction of the air into the nozzle, and for other reasons which include those given above, there is a need to reduce the excess vapors by appropriate processing means to prevent their discharge to the atmosphere. Related to this is a general environmental concern at regulatory agencies about increased pressurization of storage tanks caused by excess vapors.

This increased pressurization has resulted in so-called "fugitive emissions" as vapors leak from the pressurized storage tank into the outside environment, which is at a lower pressure. Prior art methods of vapor recovery have not fully solved the problem of significantly reducing fugitive emissions.

A vapor collection and disposal system is disclosed in U.S. Pat. No. 3,999,936 to Hasselmann. This patent discloses collection of vapors and processing the vapors by burning after the storage tank is pressurized. Burning thermally oxidizes the vapors and yields carbon dioxide and water, both of which can be safely absorbed by the environment. Pressure in the underground storage tank is used to push the vapors to the combustion chamber. If all the tank fittings are not tight, the possibility of fugitive emissions exists. This patent does not disclose methods for directly diverting and treating excess vapors, rather than sending them back to the storage tank, nor for immediately dealing with increased pressurization of the storage tank that may occur for various other reasons. Quick response is important because the risk of fugitive emissions leaking into the environment is present at any time the fuel storage tank is above atmospheric.

Another vapor recovery system is proposed in U.S. Pat. No. 5,040,577 to Pope. This patent employs a bellows type nozzle and is generally directed toward controlling the volummetric flow of vapor being recovered in order to attain efficient fuel flow and ease of handling of the nozzle by a user. The system of Pope attempts to bring back the same volume of vapors as liquid dispensed, that is, to operate at a V/L (vapor to liquid) ratio of one. Pope does not provide methods, apparatus, or systems to reduce or eliminate fugitive emissions. As a matter of fact, it cannot function with a larger volume of vapors returned without pressurizing the storage tank and causing fugitive emissions.

The Hirt invention, described in U.S. Pat. No. 4,009,985, also uses a bellows type nozzle. Hirt uses a vacuum source downstream of the storage tank to place the whole underground storage tank in a vacuum. This vacuum, in turn, is piped to the dispenser nozzles to draw back vapors. The exhaust from the vacuum source is connected to a burner to flare off the emissions. The Hirt invention is limited in the amount of vacuum that it can draw at the nozzle because it is the same amount of vacuum applied to the head space of the storage tank. A high vacuum weakens the tank structure as well as causing evaporation of the gasoline in the storage tank. The inability to have a vacuum above a few inches of water column also prevents the Hirt invention from being used with the small diameter vapor return hose in the co-axial dispenser hoses.

Evidence of the fugitive emission concern, and confirmation of the 95% vapor recovery figure, is revealed in a Memorandum dated 24 Feb. 1993 from the State of California Air Resources Board. This provides excellent background for the above discussion.

SUMMARY OF THE INVENTION

Broadly speaking, the present invention is a method and system for collecting vapors discharged from a vehicle fuel tank during refueling and processing excess combustible vapors recovered in order to prevent their contributing to increased pressurization in storage tanks for the volatile liquid. While it will be described in conjunction with the processing of vapors collected by nozzles that dispense gasoline to vehicles, it should be understood that the invention may be utilized whenever flammable vapors must be collected and returned, so as to result in pressurizing tanks storing those liquids. A primary purpose of this invention is to prevent the subsequent release of the vapors to the environment.

Fuel vapors are collected from a nozzle that delivers liquid fuel to a vehicle by a collection unit, which may be a vacuum assisted pump. The collection unit is started when the fuel delivery pumps are started. Vapors are sent to the a fuel storage tank and excess vapors are sent directly to a processing unit. Processing may be accomplished by combustion/incineration, refrigeration/condensation, catalytic oxidation or in other ways which may even be presently unknown. A novel aspect of the invention is that a single collection unit is used to collect the vapors as well as to send them to the storage tank and to the processing unit. This is accomplished by a split line, one branch of which includes a restrictor plate, the other branch leading to a pressure sensitive activation means in the processing unit. The restrictor device is in communication with the storage tank and the processing unit to control the flow of vapors being sent to the storage tank. Thus increased pressure in the storage tank, resulting from excess vapors collected during fuel dispensing, is greatly reduced or eliminated by the present invention. Advantageously, fugitive emissions can be eliminated, thus reducing air pollution as well as eliminating safety hazards due to the pressurization (e.g., ground leaks, rupturing of the tank, and explosions) of underground storage tanks.

A recirculation loop, which includes another restrictor plate in piping from the outlet of the collection unit back to the inlet of the unit, provides a means for processing of excess vapors when no fuel dispensing is occurring. This is advantageous because it reduces the chances of fugitive emissions being released to the environment caused by increased pressurization in the fuel storage tank due to vapor growth from a number of factors including a change in ambient temperature and gasoline volatility, among others previously enumerated. The recirculation loop also provides for adjustment of the vacuum applied to the nozzle.

Alternative to employing restrictor plates in the vapor recirculation loop, a flow regulator can be used.

BRIEF DESCRIPTION OF THE DRAWING

The object, advantages and features of this invention will be more clearly understood from the following detailed description, when read in conjunction with the accompanying drawing, wherein:

FIG. 1 is a side, partially cut away view of a prior art bellowless fuel dispensing nozzle useful with the present invention;

FIG. 2 shows an alternative nozzle inserted into a vehicle tank fill neck;

FIG. 5 is a graph of exemplary pump characteristics.

DETAILED DESCRIPTION OF THE PREFERRED EMBODIMENTS

Figure 3:
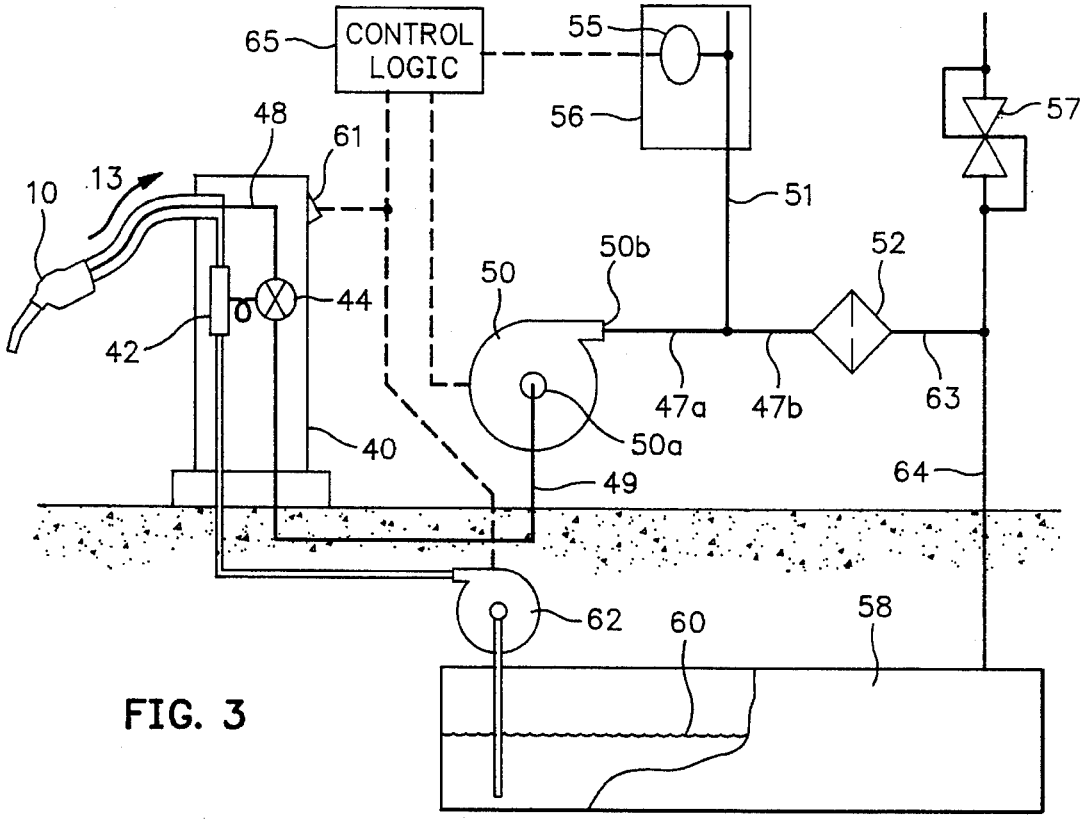
FIG. 3 is a schematic diagram of a basic preferred embodiment of the present invention.

With reference now to the drawing, and more particularly FIG. 3, there is shown the basic vapor recovery and processing system of the invention. Collection unit 50 is provided to draw vapors from nozzle 10 in the direction of arrow 13 through lines 48 and 49. Preferably the collection unit is a vacuum pump although other mechanisms for inducing a vacuum upon the vapors may occur to those skilled in the art. Collection unit 50 is automatically started when fuel delivery pump 62 is actuated, such as by hook switch 61. The signal from the hook switch is coupled to control logic 65 which is connected to the various sensors and actuators of the system as will be fully described below. Vapor control valve 44 disposed in vapor return piping line 48, 49, and housed in dispenser 40, keeps the vapor return line closed until liquid fuel 60 is delivered by pump 62 through nozzle 10 when the valve in the nozzle is opened by the operator during refueling of a vehicle. Upon flow of fuel through the dispensing nozzle, as detected by flow sensor 42, the vapor flow control valve opens to allow fuel vapors to be drawn by the collection unit. While it is peripheral to the invention, it might be noted that the dispensing apparatus could employ a vapor flow valve in nozzle 10 rather than the vapor valve and sensor combination shown. That vapor flow valve is actuated when gasoline flows through the nozzle. It should be understood that all references to bellowless nozzles and their particular mechanisms for gathering vapors (e.g., openings 18, or 18 and 19) are only by way of example since the invention described herein can be used with any particular mechanism for gathering vapors, including nozzles having bellows.

Vapors are drawn through return line 48, 49 to inlet **50*a* of the collection unit. Vapors are discharged from pump outlet 50*b* through pipe lines 47*a* and 51 to vapor processing unit 56, and through lines 47*a*, 47*b*, 63 and 64 to storage tank 58. The vapor processing unit may be any type of known, or even presently unknown, unit capable of converting a combustible mixture to environmentally safe constituents. Possibilities include combustion, refrigeration and catalystic oxidation, among others. For exemplary purposes, a combustion unit will be described as such a processing unit because it provides an efficient way to break down hydrocarbons into environmentally safe constituents. Thus, vapors sent to processing unit 56** are thermally oxidized or flared thereby to $CO_2$ and $H_2O$ vapor.

A novel aspect of the present invention is that a single collection unit 50 collects vapors from nozzle 10 and sends the vapors both to combustion unit 56 and storage tank 58. This significantly reduces cost since one pump performs those two functions through the two outlet lines from the pump as described below. This is made possible by the fact that the vacuum source is located between the nozzle and the storage tank and not downstream of the storage tank.

The line to the storage tank has flow restrictor 52 in it. This effectively divides the vapors discharged from pump 50 in the ratio of recovered vapors to ambient air collected at nozzle 10. For the reasons previously stated, the total vapor volume in lines 48, 49 normally exceeds the volume of vapors forced out of the tank being filled by the entering liquid. This is the V/L ratio, the volume of vapors to the volume of liquid. If the V/L ratio at the nozzle is 1.4:1, for example, then one volume of vapors is sent to storage tank 58 and 0.4 volume of vapors is sent to processing unit 56. This results in the same volume of vapors being sent to the storage tank as liquid is removed therefrom.

The openings in restrictor plate 52 may have any pressure drop desired or as necessary to accomplish the vapor division specified. Further, the openings may be adjustable.

Figure 4:
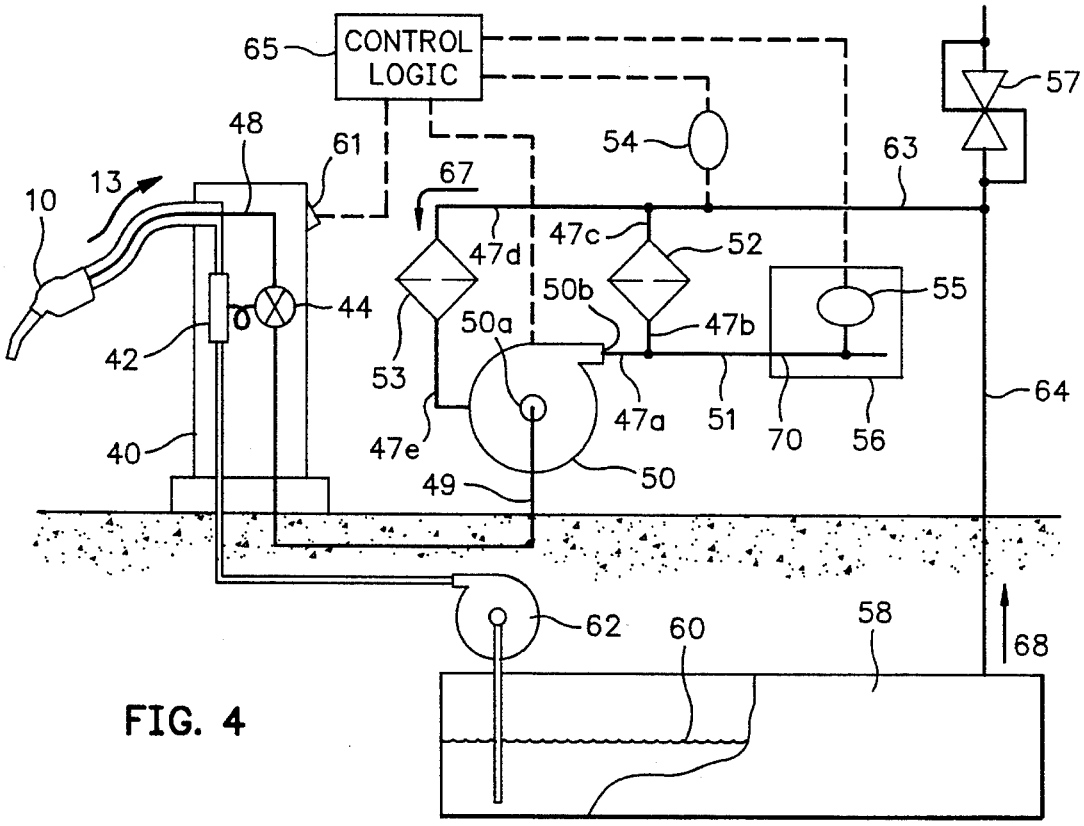
FIG. 4 is a schematic diagram of an alternative embodiment of the invention.

An improved and preferred version of the vapor recovery system and method of the invention is shown in FIG. 4. This system operates similarly to the FIG. 3 embodiment, but with the addition of a recirculation loop which includes a second restrictor plate, and a storage tank pressure switch. This allows the collection unit and the processing unit to lower storage tank pressure by processing vapors even when dispensing by means of nozzle 10 is not occurring.

Recirculation loop 67 comprises pipe lines 47*a*, 47*b*, 47*c*, 47*d*, and 47*e*, and restrictor orifices 52 and 53. This loop, together with pump 50, enables continuous processing of excess vapors from storage tank 58 until a predetermined nominal reduced pressure level is reached in the storage tank. The vapors discharged through outlet 50*b* into pipe line 47*a* and 47*b* flow through slight restrictor orifice 52 to the storage tank to replace a volume equal to the liquid withdrawn from the tank during filling of the vehicle fuel tank. The remainder of the vapors in excess of that necessary to replace the liquid volume, and not flowing through restrictor 52, flows into combustion unit 56 where it is incinerated, as previously described with respect to the FIG. 3 system.

Second restrictor orifice 53 allows recirculation of vapors back to inlet 50*a* of the collection unit. This second restrictor sets the inlet vacuum level of the collection unit. The circulation loop uses the storage tank as the lowest pressure setting in the system. Thus, when the collection unit is triggered by actuation of hook switch 61, the recirculation flow builds up a pressure at processing unit 56, causing it to start and incinerate or flare off vapors. This draws the vapors from storage tank 58 in the direction of arrow 68 until the negative pressure on the storage tank causes the pressure on the upstream side of orifice 52 to fall below the starting pressure, as determined by pressure sensitive switch 55 for the processing unit. The processing unit then stops flaring vapors and no more vapors are drawn from the storage tank.

Additional vapors collected from nozzle 10 cause more vapor to flow through restrictor 52. In turn, this raises the pressure at pressure switch 55 to the starting threshold for processing unit 56. The fuel mixture vapors are again burned to yield $CO_2$ and $H_2O$ vapor. During fuel flow from nozzle 10, vapors also flow through orifice 52 to the storage tank to replace the fuel volume that has been withdrawn. The storage tank pressure is maintained at a level just slightly below atmospheric by means of the pressure setting of switch 55 in the processing unit and the pressure drop across orifice 52. By maintaining such a pressure, the risks of fugitive emissions is greatly reduced because vapors tend to flow in the direction of lowest pressure.

An additional advantage provided by the present invention is the ability to react almost immediately upon measuring increased tank pressurization, regardless of whether liquid fuel is being delivered at nozzle 10. Collection unit 50 is started when the storage tank pressure, measured by switch 54, is above a certain threshold value. The preferred threshold value is –0.1 inches water column (in. WC) in accordance with this invention. The processing unit pressure switch 55 is also set to close at a nominal level. In this example situation, a good relative choice for switch 55 would be +1.0 in. WC. Collection unit 50 remains on, even after nozzle 10 and hook switch 61 are off, as long as the tank pressure is above –0.1 in. WC and pressure switch 54 is closed.

The pressure drop between process unit inlet 70 and storage tank line 63 is governed by the flow through restrictor 52 and the diameter of the orifice in restrictor 52. A preferred value for the pressure drop when pump 50 is operating, following the exemplary values given, is a nominal 1.5 in. WC. In this exemplary case, as long as the storage tank pressure is above –0.5 in. WC and there is vapor flow through the recirculation loop, the processing unit inlet pressure will be above 1.0 in. WC. This will in turn close switch 55. An additional modification is to start processing unit 56 only after the storage tank pressure is at or above –0.1 in. WC, which occurs when switch 54 closes. It can be seen that the processing unit operates as a function of pressure, not as a function of operation of the collection unit. This prevents continuous cycling.

Once the process unit is started, it will continue to operate until inlet pressure switch 55 opens. Switch 55 will open when the storage tank pressure drops below –0.5 in. WC. After the process unit shuts down, collection unit 50 is automatically turned off if there is no demand from dispenser 40. In a typical dispensing facility there are a plurality of dispensers 40, all connected to the system of FIGS. 3 or 4.

If the storage tank pressure goes above –0.1 in. WC due to vapor growth, pump 50 is started. Since the storage tank pressure is above –0.5 in. WC, the recirculation flow causes processing unit inlet 70 to be higher than 1.0 in. WC. This causes pressure switch 55 to close and start processing unit 56. Processing then continues until pressure in storage tank 58 drops below –0.5 in. WC, resulting in the pressure upstream of orifice 52 falling below 1.0 in. WC with recirculation flow, whereupon switch 55 opens and pump 50 and processing unit 56 are shut down. The present invention thus provides a system and method for maintaining the storage tank pressure between a nominal –0.1 in. WC and –0.5 in. WC by selecting predetermined threshold pressures for switches 54 and 55 as described above.

Restrictor orifices 52 and 53 may be of any type well known in the art. An example of such a restrictor would be an orifice plate having a small diameter hole, adapted in size to limit the flow volume to an acceptable rate at nominal pressure levels. The restrictors could also have an adjustable opening, or even a pulsed opening and closing function, depending on the downstream tank pressure. The nominal pressure settings of pressure sensitive switches 54 and 55 can be adjusted to compensate for slight variations in the orifice diameters to yield a desired flow rate. Additionally, the restrictors may be used to determine approximately how much vapor is processed by the combustion unit and how much is returned to the tank. For example, if the return vapor volume to dispensed liquid volume ratio is 1.4:1, meaning that 1.4 times as much vapor volume is collected by the nozzle as the volume of liquid fuel displaced, then an appropriately sized restrictor allows for 0.4 volume of a collected fuel mixture to be processed and the remainder returned to the storage tank.

In the event that an unusually high pressure is sensed in tank 58, pressure/vacuum relief valve 57 is provided in pipe line 64 to relieve the condition by venting vapors. This is an abnormal situation, especially since the present invention enables consistent processing of excess vapors contributing to increased pressure. However, valve 57 is a safety feature and functions only in such abnormal conditions.

FIG. 5 is a graph of vacuum level vs. volume rate of flow of the vacuum pump. Line 75 is the basic, unmodified pump flow curve. The flow is changed as indicated by line 76 when fixed orifice restrictor 53 is positioned in recirculation loop 67 (FIG. 4). If a flow regulator is employed in place of restrictor 53, the flow is improved as evidenced by line 77. Reference numeral 53 also serves to indicate a flow regulator as an alternative element in FIG. 4.

A preferred embodiment of the present invention has been described for a hydrocarbon vapor recovery system and method for processing excess vapors in a safe manner to eliminate fugitive emissions which cause air pollution. It should be understood that modifications and improvements thereof may occur to persons skilled in the art. Therefore, coverage afforded the present invention should only be limited in accordance with the spirit and scope of the appended claims.

What is claimed is:

1. A vapor recovery method for collecting vapors emitted during vehicle refueling and for processing excess vapors form a dispensing system in order to prevent increased pressurization of a storage tank of combustible liquid, the storage tank being maintained at or below atmospheric pressure, the storage tank also being in selective fluid communication with a nozzle in the dispensing system for dispensing the combustible liquid into the vehicle fuel tank, the nozzle having means for capturing the vapors forced from the vehicle tank, said method comprising the steps of:

collecting the combustible vapors at the nozzle by a collection means connected thereto, the volume of vapors thus collected being those vapors forced from the vehicle tank by the entering liquid and any air drawn in at the nozzle;

discharging a portion of the collected vapors from the collection means to a processing means, the volume of that portion of the collected vapors being directly determined by the vapor pressure in the storage tank;

processing the portion of the collected vapors discharged to the processing means to an environmentally safe form by the processing means; and discharging the remainder of the collected vapors from the collection means to the storage tank in sufficient volume to maintain a predetermined vapor pressure in the storage tank.

2. The method recited in claim 1, wherein the collection means is a vacuum pump.

3. The method recited in claim 1, wherein the processing means is a combustion unit.

4. The method recited in claim 1, and comprising the further step of dividing the vapors discharged from the collection means by means of a restrictor plate in a conduit connected to the discharge end of the collection means so that vapors in excess of those necessary to replace liquid volume in the storage tank are directed to the processing means.

5. The method recited in claim 1, and comprising the further steps of:

sensing pressure in the storage tank above a predetermined level;

actuating the collection means in response to the increased pressure;

reducing the increased pressure by drawing the excess vapors back from the storage tank through a recirculation loop to the collection means intake;

discharging the excess vapors to the processing means; and processing the excess vapors to an environmentally safe form.

6. The method recited in claim 5, wherein the recirculation loop includes a restrictor plate.

7. A vapor recovery method for collecting vapors emitted during vehicle refueling and for processing excess vapors in a dispensing system in order to prevent increased pressurization of a storage tank of combustible liquid maintained at or below atmospheric pressure, wherein the increased pressurization is prevented above a predetermined level, the storage tank being in selective fluid communication with a nozzle in the dispensing system for dispensing the combustible liquid into the vehicle fuel tank, the nozzle having means for capturing the vapors forced from the vehicle tank and also for capturing air, said method comprising the steps of:

collecting the combustible vapors at the nozzle by the collection means connected thereto the volume of vapors thus collected being in excess of those vapors forced from the container by the entering liquid;

discharging a portion of the collected vapors from the collection means to a processing means the volume of that portion of the collected vapors being directly determined by the vapor pressure in the storage tank;

processing the portion of the collected vapors discharged to the processing means to an environmentally safe form;

discharging the remainder of the collected vapors from the collection means to the storage tank in sufficient volume to maintain the predetermined pressure in the storage tank; and when combustible liquid is not being dispensed through the nozzle:

sensing the pressure in the storage tank by a first pressure sensing element;

providing an actuation signal when the pressure in the storage tank exceeds the predetermined level;

commencing operation of a vapor collection means in response to the actuation signal, the collection means being coupled to the storage tank by means of a fluid conduit which includes a recirculation loop from the discharge to the intake of the collection means;

discharging vapors form the discharge of the collection means to the input of the processing means, and processing the vapors in the processing means to an enviormentally safe form.

8. The method recited in claim 7, and comprising the further steps of:

sensing when the pressure in the storage tank has been reduced to at least the predetermined level; and turning off the processing means and the collection means.

9. The method recited in claim 7, wherein the collecting means is a vacuum pump.

10. The method recited in claim 7, wherein the processing means is a combustion unit.

11. The method recited in claim 7, wherein the first pressure sensing element is a pressure switch.

12. The method recited in claim 11, wherein operation of the collection means causes pressure to rise to a first predetermined level at the first pressure switch and also to rise to a second predetermined level at a second pressure switch coupled to the processing means, thereby causing the first and second pressure switches to close and thereby starting the processing means.

13. The method recited in claim 12, wherein the processing of the combustible vapors in the processing means draws the vapors from the storage tank such that pressure at the first pressure switch eventually falls below a predetermined level thereby opening the first pressure switch and stopping the processing means.

14. The method recited in claim 12, wherein a rise of pressure in the storage tank causes the second pressure switch to close thereby starting the collection means.

15. The method recited in claim 14, wherein starting of the collection means results in a rise of pressure at the first pressure switch causing the first pressure switch to close thereby starting the processing means.

16. The method recited in claim 7, wherein the recirculation loop includes at least one restrictor plate.

17. The method recited in claim 7, wherein the recirculation loop and sensing element use the storage tank as the lowest pressure setting in the system.

18. The method recited in claim 7, wherein the recirculation loop includes a flow regulator.

19. The method recited in claim 7, wherein the recirculation loop includes means for regulating flow.

* * * * *